United States Patent [19]

Siegenthaler

[11] 4,390,296

[45] Jun. 28, 1983

[54] PRINTING MACHINE

[75] Inventor: Fritz Siegenthaler, Trub, Switzerland

[73] Assignee: Autelca, AG, Switzerland

[21] Appl. No.: 300,912

[22] Filed: Sep. 10, 1981

[30] Foreign Application Priority Data

Sep. 19, 1980 [CH] Switzerland ..... 7030/80

[51] Int. Cl.[3] ..... B41J 15/18; B41J 11/50

[52] U.S. Cl. ..... 400/608; 400/607; 400/608.3; 400/621; 400/624

[58] Field of Search ..... 400/518.3, 518.4, 519, 400/519.1, 519.6, 605, 607, 608, 608.3, 617, 613.1, 621, 624, 628; 226/110, 108; 271/9, 268; 242/56.1

[56] References Cited

U.S. PATENT DOCUMENTS

| | | | |
|---|---|---|---|
| 1,241,897 | 10/1917 | Ananson | 271/9 X |
| 1,417,472 | 5/1922 | Marsh | 400/605 X |
| 1,704,618 | 3/1929 | Mailaender | 271/268 |
| 1,880,519 | 10/1932 | Stevens | 226/110 |
| 1,965,404 | 7/1934 | Biele | 400/609 |
| 2,628,092 | 2/1953 | Malmros et al. | 271/268 X |
| 3,182,539 | 5/1965 | Williams | 226/110 X |
| 3,850,356 | 11/1974 | Abe et al. | 226/110 |
| 3,920,238 | 11/1975 | Kitajima et al. | 271/9 |
| 4,234,261 | 11/1980 | Hendrischk et al. | 400/621 |

*Primary Examiner*—Paul T. Sewell

*Attorney, Agent, or Firm*—Brady, O'Boyle & Gates

[57] ABSTRACT

Several guide channels (6, 7) for respectively one paper web are arranged in a fan shape, these channels being oriented toward the nip (5) of a pair of feed rolls (1) of a printing device (2, 3) and each being equipped with a gripper (8, 9). In the rest position, each gripper (8, 9) is in contact with a web of paper, and the free ends of the paper webs have a spacing from the nip (5). The gripper (9) for the paper web to be printed advances the latter until it has entered the nip (5) of the rotating pair of rolls (1), then releases the web, and initially remains in its position (8). The pair of rolls (1) further conveys the paper web first into its printing position, after the printing step into its cutting position, and after cutting again in the reverse direction. Before the paper web leaves the nip (5), the gripper (8) engages once more and returns into its rest position (9), entraining the paper web, so that the end of the latter, produced by the cutting step, assumes the position occupied by its previous free end prior to the advancement of the grippers. In this way, it is possible to print in any desired sequence onto various paper webs and also directly in succession onto one and the same paper web.

8 Claims, 6 Drawing Figures

Fig.2
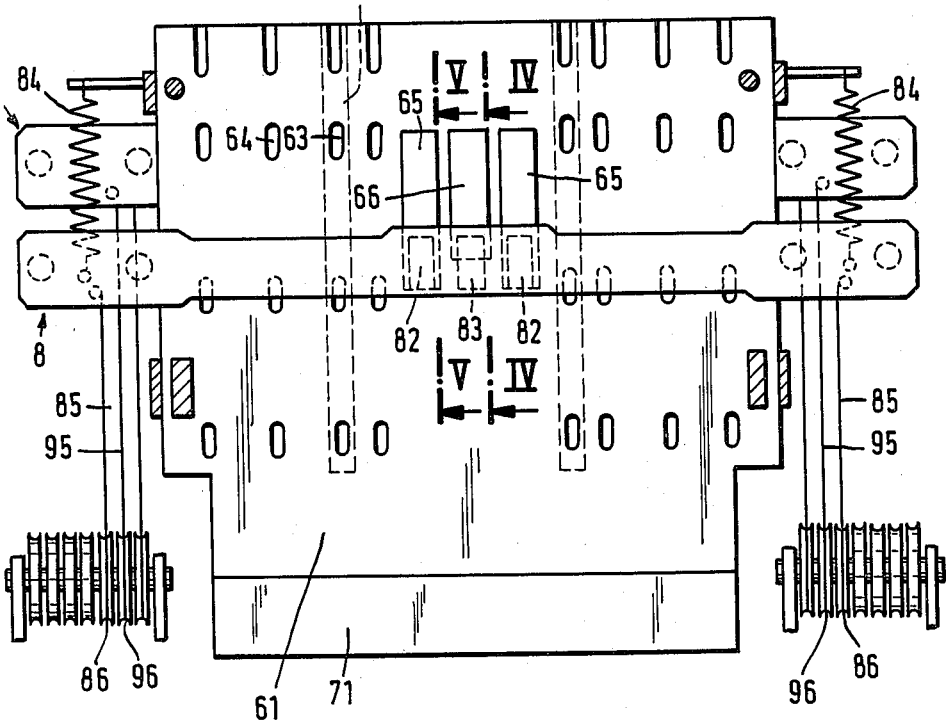
Fig.3
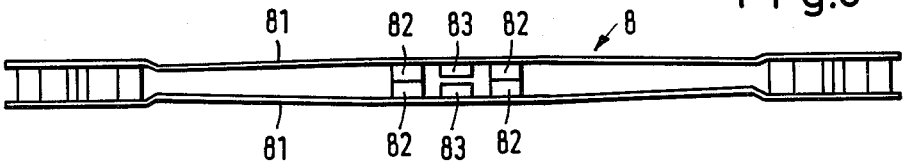
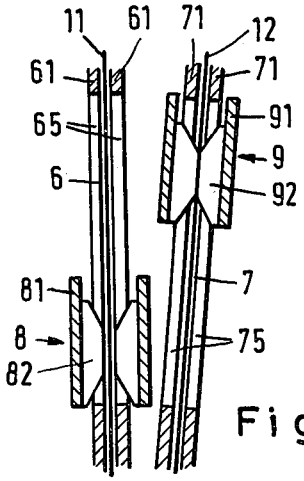
Fig.5
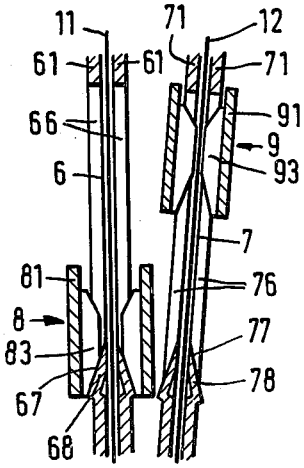
Fig.4

PRINTING MACHINE

BACKGROUND OF THE INVENTION

The invention relates to a printing machine with a pair of feed rolls for conveying a length of printing material to be imprinted in sections, with a printing device, and with a cutter for the printed sheet section.

SUMMARY OF THE INVENTION

The invention solves the problem of providing a printing machine of this type, by means of which a length of printing material, selected from several such lengths of printing material, can be imprinted, wherein these lengths of material are, for example, of differing widths, different colors, or provided with different basic or first printings. A further development of the invention makes it possible to arrange the guide channels for a relatively large number of lengths of printing material in relatively close adjacency, in which grippers occupying only a small amount of space serve as the conveying means, the gripping and release movements of these grippers being controlled by means which practically do not take up any space at all.

One embodiment of the invention is described in greater detail hereinafter following with reference to the appended schematic drawings.

BRIEF DESCRIPTION OF THE DRAWINGS

FIG. 2 shows a section along line II—II in FIG. 1;

FIG. 3 is a lateral view of a gripper;

FIG. 4 is a section view substantially along line IV—IV in FIG. 2 on an enlarged scale;

FIG. 5 is a section view substantially along line V—V in FIG. 2 on an enlarged scale.

DESCRIPTION OF THE PREFERRED EMBODIMENT

Figure 1:
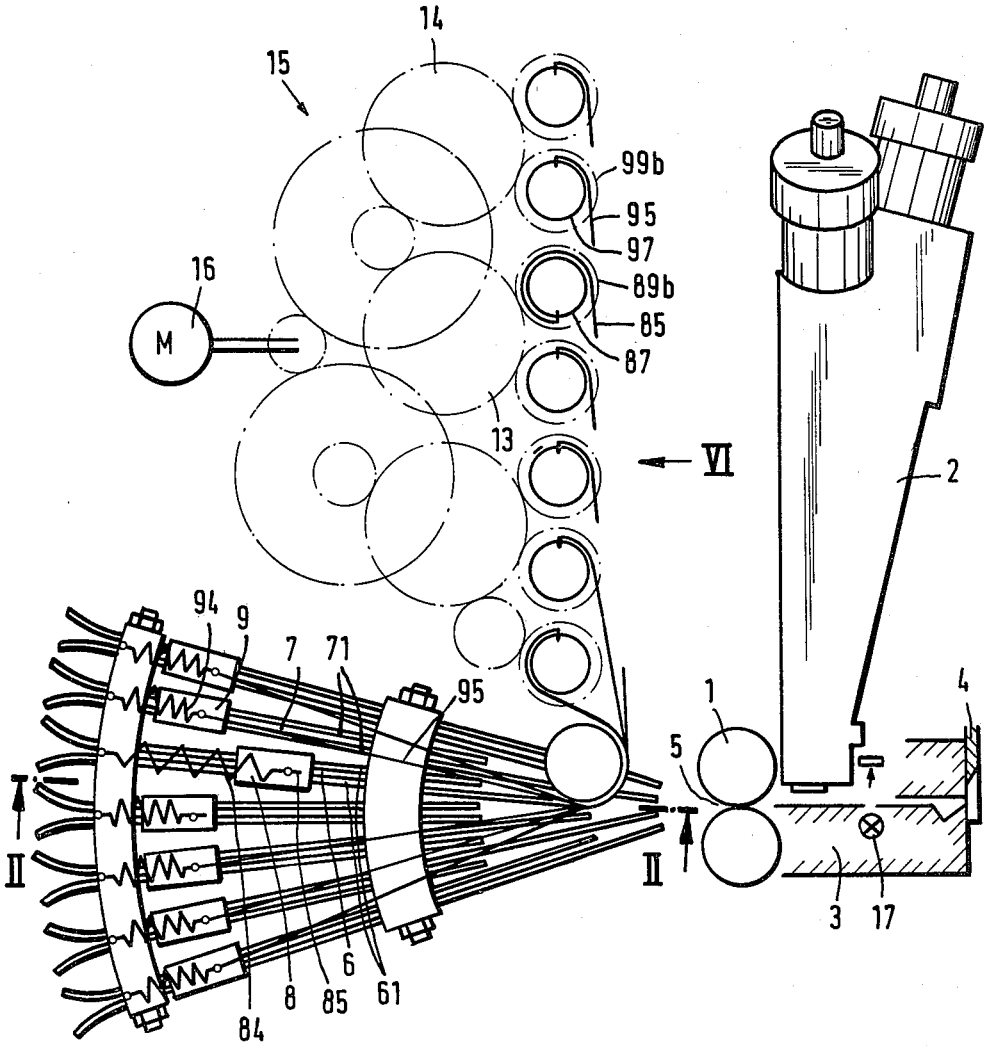
FIG. 1 is a simplified schematic lateral view of a printing machine wherein printing can be carried out selectively in any desired sequence, respectively on one of seven lengths of printing material, and the thus-imprinted sheet section can be cut off.

In FIG. 1, numeral 1 denotes the pair of feed rolls, 2 denotes the matrix printing head, 3 denotes the printing platen of the printing device, and 4 is the blade constituting together with a counter blade formed at the printing platen the cutter for the printing machine, which latter is constructed as a matrix printer. The matrix printing head 2 is displaceable and is driven at right angles to the plane of the drawing, as described, for example, in U.S. application Ser. No. 06/135,550 and European Patent Application No. 80101133.9. The blade 4 can be driven as disclosed in U.S. appln. Ser. No. 06/136,517 and European Patent Appln. No. 80101205.5, and the inked-ribbon transport means, not shown, can be designed as set forth in European Patent Appln. No. 80101248.5. The conventional matrix printers of this type operate, for printing of sections from one and the same paper web, in such a way that the feed rolls 1 move the paper web to be imprinted into its printing position, optionally for the line-by-line printing mode into several printing position in succession; further move the paper web after printing into the cutting position; and after cutting off the printed paper section, move same back into the printing position, if applicable into the first printing position. In the present machine, the matrix printer 1–4 operates essentially in the same way, but with the difference that the pair of rolls 1 does not shift the paper web, after cutting, into the printing position but rather, as explained hereinbelow, pushes the web further back, namely until it is disengaged from the nip 5 of the rolls 1; and that the paper web, before each printing step, is introduced between the rolls 1 and advanced thereby into the printing position, optionally into the first printing position.

For seven paper webs to be printed selectively in any desired sequence, seven flat guide channels, two of which are denoted by 6 and 7, are arranged in a fan shape respectively between two parallel channel walls; these guide channels are oriented toward the side of the nip 5 facing away from the printing device 2, 3. For the lateral guidance of each paper web, two guides are arranged between the channel walls of each guide channel, held by lugs engaging in holes of the channel walls. To adapt to varying widths of paper webs, several rows of holes are provided, see the channel wall 61 of channel 6, the guides 62 with the lugs 63, and the rows of holes 64 in FIG. 2.

In order to make do with a small angle between neighboring channels and thereby to accommodate a maximum number of guide channels within a given angle, only the outermost channel walls, and two of the interposed channel walls are extended to the end of the channel arrangement adjacent the nip 5, and the other channel walls are made to be shorter, wherein neighboring channels terminate one into the other; this is shown in FIG. 1. Planar-parallel spacers, not shown, between the two channel walls of each guide channel and spacers having the shape of a truncated wedge, not shown, between adjacent guide channels, as well as suitable connecting means, hold the channel arrangement together.

The guide channel 6 is associated with a gripper 8, the guide channel 7 with an identical gripper 9, and the other guide channels are each associated with another, identical gripper for the advancing and pushing back of the paper web disposed in the respective channel. These paper webs are not shown in FIG. 1. In FIGS. 4 and 5, the paper web in guide channel 6 is denoted by 11 and in guide channel 7 by 12. Each gripper is constructed as will be described below in connection with FIGS. 2–5 in greater detail, and is displaceable by means of a drive mechanism along an advancing and return path extending over a portion of the associated channel facing away from the nip 5; this path is disposed in the same way in all channels and corresponds approximately to the spacing between the fan-shaped arrangement of the channels and the nip 5. In FIGS. 1, 2, 4, and 5, the gripper 8 is at the end of the advancing path (i.e. the beginning of the return path), and the gripper 9 is at the beginning of the advancing path (i.e. the end of the return path). The grippers, as will be explained in conjunction with FIGS. 4 and 5, are controlled so that a final portion of the advancing path is associated with the release movement of the gripper, the initial portion of the return path congruent therewith is accordingly associated with the gripping movement of the gripper, and the remaining portion of the advancing and return path is associated with the gripping position of the gripper.

The drive speed and direction of each gripper is adapted along the entire advancing and return path to the peripheral speed and direction of rotation of the pair of rolls 1. It is basically sufficient if, directly before and during release of the gripper, the speed of the latter is the same or a little higher than that of the roll pair, and during and immediately after the gripping movement, the speed of the gripper is equal to or somewhat lower than that of the roll pair. In the rest condition of the printing machine, the free ends of the paper webs have all the same distance from the nip 5. This distance is somewhat smaller than the advancing and return path of the grippers, and each gripper is in the rest position shown for gripper 9 in FIG. 1, wherein it is in the gripping position, i.e. it grips the paper web and retains same.

If printing is to be performed on a paper web, then the gripper associated with this paper web or its guide channel is advanced, and thus entrains the paper web. When the gripper approaches the end of its advancing path, the paper web enters the nip 5 of the pair of rolls 1; shortly thereafter the gripper executes its release movement, remaining in this position. The pair of rolls 1 pushes the paper web forward into the printing position wherein it is imprinted, and further into the cutting position wherein it is cut off, and thereupon in the reverse direction. Shortly before the rearwardly pushed paper web leaves the nip 5 of the roll pair 1, the gripper begins its return movement wherein it first executes its gripping movement and thereafter entrains the paper web which leaves the nip 5 of the roll pair 1. At the end of the return path, the gripper is once again in its rest position, and the free end of the paper web, produced by the cutting of the printed piece of paper web, is again in the position occupied by the end present before the cutting step, prior to the entire procedure. This is due to the fact that the gripper advance was terminated shortly after entrance of the original paper web end into the nip 5, while the return path began shortly before exiting of the new paper web end from the nip, and the advancing path is equal to the return path. The gripper and the rolls are driven by stepping motors, since the latter are exactly controllable for certain revolutions. The required revolutions of the rolls result from the spacings of the nip from the printing site and the cutting site. By the indicated dimensioning of the advancing and reverse speed of the gripper, the objective is attained that the paper web is neither overfed nor pulled under tension if it is temporarily conveyed by the gripper as well as by the pair of rolls.

As shown in FIGS. 2–5, using gripper 8 and, in part, also gripper 9 as example, each gripper has two spring metal strips 81 and 91, respectively, which are held at a mutual distance at their ends by spacers, are then bent toward each other, and diverge toward the middle. The spring metal strips 81 of gripper 8 are arranged on the outside of the channel walls 61 of the associated guide channel 6, and their angled points are guided therealong. Corresponding conditions apply to the other grippers. On the inside of the metal spring strip 81 or 91, respectively one gripping jaw 82 or 92 is arranged, pertaining to two gripper jaw pairs, and respectively one cam 83 or 93 of a cam pair located between the gripper jaw pairs 82 and 92 is likewise mounted to this inside of the metal spring strips. The gripper jaws 82 and 92 extend through respectively one opening 65 and 75 in the channel walls 61 and 71 and the cams 83 and 93 extend through respectively one opening 66 and 76 of the channel walls 61 and 71. These openings are fashioned as slotted holes to make it possible for the grippers 8 and 9 to execute a forward and backward movement. The spring metal strips 81 and 91 are pretensioned so that the gripper jaws 82 and 92 are pressed together in the rest condition of the grippers 8 and 9, and the cams 83 and 93 are not in mutual contact (and do not contact the paper web, either), so that the spring force of the spring metal strips 81 and 91 acts entirely on the gripper jaws. To establish a reliable, frictional engagement of the gripper jaw pairs 82 and 92 with the paper web 11 or 12 in the channel 6 or 7, they consist of a material (synthetic resin) having a high friction coefficient. In contrast thereto, the cams 83 and 93, respectively, consist of a material (another synthetic resin) of a high slip power so that they readily slide along their associated control surfaces, as will be described below.

The cams 83 and 93 of the grippers 8 and 9 move, during the release and gripping motions of the latter, along control surfaces 67 and 77 formed at wedge-shaped bulges 68 and 78 of the channel walls 61 and 71. Otherwise, the cams 83 and 93 extend through the slotted holes 66 and 76, respectively, in the channel walls 61 and 71. These slotted holes 66 and 76, however, are shorter than the slotted holes 65 and 75 into which the gripper jaws 82 and 92 extend, because the cams 83 and 93 slide along the control surfaces 67 and 77 at the end of the advancing path and at the beginning of the reverse or return path.

FIGS. 1, 2, 4, and 5 show that the gripper 8 has reached the end of the advancing path, and its cams 83 have entered the control surfaces 67, so that its gripper jaws 82 are lifted off the paper web. Consequently, this web (11)—as described above—can be further advanced by the pair of rolls 1 and can be pushed back again after the printing and cutting processes. When the gripper 8 thereafter executes its return movement, the cams 83 run off the control surfaces 67, whereby the gripper movement is effected and the paper web 11 is seized by the gripper jaws 82 and pushed back during the return path of the gripper 8 until the gripper 8 occupies the position wherein the gripper 9 is illustrated. During this step the paper web 11 is being retained. When the gripper 9 is advanced, it entrains the paper web 12 clamped tightly between its gripper jaws 92 until its cams 93 enter the control surfaces 77. The gripper 9 then comes into the position and condition wherein the gripper 8 is illustrated, and the remarks set forth above apply.

Figure 6:
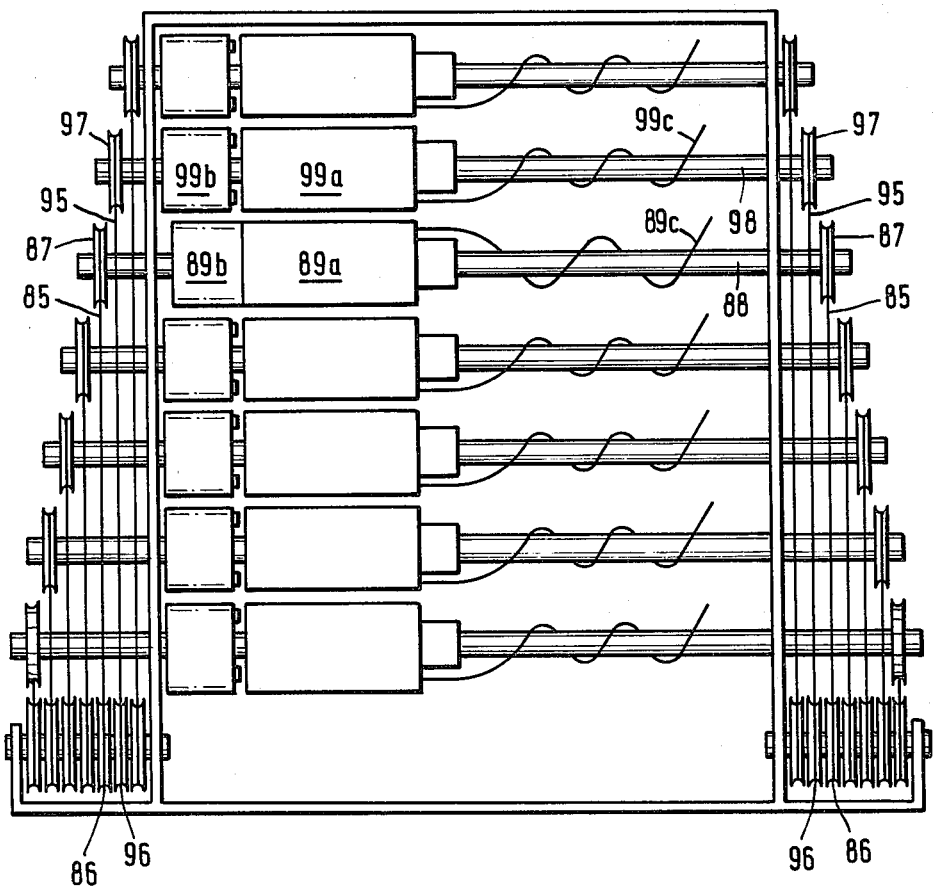
FIG. 6 is a partial elevational view taken in the direction of arrow VI in FIG. 1.

To effect the drive action in the forward and return directions, each gripper is connected with a pair of tension springs acting in the return direction, as well as with a pulley acting against the tension springs, as indicated in FIGS. 1 and 6, and, using the gripper 8 and partly also the gripper 9 as an example, also in FIG. 2. Thus, the gripper 8 is connected with a pair of tension springs 84, fixedly supported, and with a pair of elongation-resistant cables 85. The corresponding cables of the gripper 9 are denoted by 95 in FIGS. 1 and 2. In FIG. 1, the cable of the pair 95 visible therein is only partially illustrated. Each cable 85 and 95, respectively, runs over a freely rotatable guide roller 86 and 96, respectively, to a pulley disk 87 and 97, respectively, at which the cable end is attached. The pulley disks of each pair 87 and 97 are firmly seated on a shaft 88 and 98, respectively, the rotation of which is limited by means of stops, not shown, in the direction corresponding to the tension [pulling] direction of the springs, for example 84, whereby the rest position of the grippers 8 and 9 is defined. A coupling member **89*a* and 99*a* is seated on each shaft 88 and 98, such coupling member pertaining to a shape-mating, electromagnetically shiftable clutch, the other coupling member 89b, 99b of which is disposed to be rotatable and displaceable on the shaft 88 and 98, respectively. The coupling members 89b and 99b carry external teeth, symbolically illustrated, meshing also upon an axial shift of the coupling member with a gear wheel 13 or 14 of a symbolically illustrated back gear mechanism 15. The latter is driven by a stepping motor 16, and the coupling members 89b and 99b, as well as the further coupling members corresponding thereto are driven by this back gear mechanism, wherein, however, respectively only that shaft is being driven, the clutch of which has been engaged. In this connection, the stepping motor 16 is controlled in such a way that the rotation corresponds to the gripper advancing path or return path, respectively. To avoid slip rings for current supply to the members carrying the excitation winding, e.g. 89a, 99a, of the clutches, the electrical connection line thereof, e.g. 89c, 99c, is wound with such a clearance about the respective shaft, e.g. 88, 98**, that the latter can rotate unimpeded in correspondence with the advancing and reverse motion of the gripper.

The entire machine is controlled by an electronic program control unit, not shown, triggering respectively the engagement of the clutch (e.g. 89a/89b) associated with the gripper (e.g. 8) of the guide channel (e.g. 6) for the selected paper web (e.g. 11), and regulating the drive of the stepping motor 16 and of the roll pair 1, as well as the printing and cutting processes. Although the stepping motor (not shown) which drives the pair of rolls 1 is accurately controllable in accordance with the advancing and return paths to be executed by the roll pair, the feed by which the paper web enters the printing position, optionally the first of several printing positions, is not dimensioned by a correspondingly measured revolution of the rolls 1, but is terminated when a light barrier 17 (FIG. 1) responds to the free paper web end. Thereby, during each program, a quite specific position of the paper web end in the machine is determined once, and it is prevented that accidental, individually insignificant advancing or returning errors add up from one printing step to the next and finally result in rather large positioning errors. Another light barrier, not shown, is arranged in front of the roll pair and cooperates with the control device to trigger a signal once a paper web has been used up.

What is claimed is:

1. A machine for printing respectively one section of an individually selected one of a plurality of strips of printing material (11, 12) and for cutting off the printed section, comprising printing means (2) for printing on a respective section of one of said strips of said plurality of strips (11, 12);

a plurality of flat guide channels (6, 7), each for guiding one of said plurality of strips (11, 12);

a pair of feed rollers (1) connected between said printing means (2) and said plurality of flat guide channels (6, 7);

cutting means (4) connected on the opposite side of said printing means (2) from said pair of feed rollers (1) for cutting off the respective section of said one of said strips imprinted by said printing means (2);

said pair of feed rollers providing a nip (5) therebetween facing away from said printing means (2) and rotatable in one direction for advancing a respective one of said strips (11, 12) guided in the respective flat guide channel (6, 7) to said printing means (2) and then to said cutting means (4), and rotatable in the opposed direction for returning the said respective one of said strips to leave said nip (5);

said plurality of flat guide channels (6, 7) being arranged in a fan shape and oriented towards said nip (5) of said feed rollers (1);

a plurality of gripping means (8, 9) each associated with one of said flat guide channels (6, 7) and having a normally gripping position gripping the strip (11, 12) in the respective flat guide channel (6, 7), said gripping means (8, 9) being individually displaceable for advancing and returning along a path extending on a longitudinal portion of the respective flat guide channel and having a length corresponding approximately to the distance between said fan shape arrangement of said plurality of flat guide channels (6, 7) and said nip (5) of said feed rollers (1);

control means (68,83) connected between said gripping means and said flat guide channels for retaining said gripping means (8, 9) in a released position when at the forward end of said path of displacement; and displacement means (13–16, 89b, 87, 85, 99b, 97, 95) connected to said plurality of gripping means (8, 9) for advancing a selected one of said gripping means (8, 9) along said path toward said nip (5) of said feed rollers (1) in the beginning of said rotation of said feed rollers (1) and for returning at the end of the said rotation.

2. A machine according to claim 1, in which each of said flat guide channels (6, 7) includes two channel walls (61, 71), each provided with at least one opening (65, 75) fashioned as a slotted hole extending along said path of displacement of said gripping means (8,9), and at least one wedge-shaped projection (68, 78) formed on the outside of each of said channel walls (61, 71);

each of said gripping means (8, 9) including two spring strips (81, 91) urged in a direction toward each other by resilient pretensioning and extending on the outside of said channel walls (61, 71) transversely to said path of displacement of said gripping means (8, 9), and at least one gripper jaw pair (82, 92) and at least one cam pair (83, 93) connected to said spring strips (81, 91);

the gripper jaws of said gripper jaw pair (82, 92) extending each through one of said openings (65, 75) in said channel walls and the cams of said cam pair (83,93) being controlled each by one of said wedge-shaped projections (68,78) for retaining said gripper jaw pair (82, 92) in the released position when at the forward end of said path of displacement of said gripping means (8, 9).

3. A machine according to claim 2, in which said channel walls (61, 71) are provided with cutouts (66, 76), and each cam of said cam pair (83, 93), along said displaceable path of said gripping means (8, 9), where its gripper jaw pair (82, 92) is in the gripping position, extends into a respective one of said cutouts (66, 76) of said channel wall (61, 71).

4. A machine according to claim 2, in which each gripping means (8,9) has, in the middle of said spring stips (81,91), one cam pair (83, 93) connected thereto and, on either side of the cam pair, respectively one gripper jaw pair (82, 92).

5. A machine according to claim 2, in which the ends of the spring strips (81,91) of each gripping means (8, 9) project beyond the channel walls (61, 71); tension springs (84,94), acting in opposition to the advancing direction of the gripping means (8,9), and cables (85, 95) connected with respectively one of the ends of the spring strips (81,91); guide rollers (86, 96) connected to guide said cables (85,95) in the advancing direction of said gripping means (8, 9), and pulleys (87, 97) connected to said cables (85, 95) and individually drivable to pull the cables (85,95) in opposition to the action of said tension springs (84, 94).

6. A machine according to claim 5, including a common drive mechanism (13–16) for said gripping means (8, 9) having a plurality of individually switchable, shaft clutches (89*a*, 89*b*; 99*a*, 99*b*), each of said shaft clutches connected with two of said pulleys (87, 97) connected by two of said cables (85, 95) with the ends of the spring strips (81, 91) of one of said gripping means (8, 9), and said shaft clutches operable to connect said pulleys to said drive mechanism (13–16).

7. A machine according to claim 6, in which each of said shaft clutches (89*a*, 89*b*;99*a*,99*b*) has an input member (89*b*,99*b*) connected to said drive mechanism (13–16), an output member (89*a*,99*a*) with a shaft (88, 98) connected with the said two pulleys (87,97), and an electromagnet serving for engaging and disengaging purposes, each electromagnet having a connection power line (89*c*, 99*c*) wound with play around the shaft (88, 98), this play permitting the rotation of the shaft (88, 98) necessary for the advancing and return displacement of the gripping means (8, 9).

8. A machine according to claim 7, and said drive mechanism (13–16) including a reversible electric motor (16), a back gear mechanism (15) connected to said electric motor and connected for driving said input members (89*b*, 99*b*) of said shaft clutches (89*a*,89*b*;-99*a*,99*b*) by said electric motor (16).

* * * * *